US009545562B1

(12) United States Patent
McLamb

(10) Patent No.: US 9,545,562 B1
(45) Date of Patent: Jan. 17, 2017

(54) FREE-STANDING TENNIS COURT PARTITION

(71) Applicant: Jon M. McLamb, Lexington, NC (US)

(72) Inventor: Jon M. McLamb, Lexington, NC (US)

( * ) Notice: Subject to any disclaimer, the term of this patent is extended or adjusted under 35 U.S.C. 154(b) by 130 days.

(21) Appl. No.: 14/336,462

(22) Filed: Jul. 21, 2014

Related U.S. Application Data

(60) Provisional application No. 61/856,712, filed on Jul. 21, 2013.

(51) Int. Cl.
*A63C 19/06* (2006.01)

(52) U.S. Cl.
CPC ..... *A63C 19/06* (2013.01)

(58) Field of Classification Search
CPC ..... A63C 19/06
USPC ..... 473/490
See application file for complete search history.

(56) References Cited

U.S. PATENT DOCUMENTS 4,014,521 A * 3/1977 Berman ..... E04H 17/00 256/1
4,218,047 A * 8/1980 Douglas ..... E04H 3/10 24/305
4,497,483 A * 2/1985 Ahlgren ..... A63C 19/06 256/24
D695,908 S * 12/2013 Adema ..... D25/1
D703,775 S * 4/2014 Adema ..... D21/706
D712,494 S * 9/2014 Adema ..... D21/698
9,174,107 B2 * 11/2015 Dettor ..... A63B 61/00
2003/0056907 A1 * 3/2003 Caveney ..... A63B 69/00 160/135
2007/0191145 A1 * 8/2007 Winter ..... A63B 47/00 473/460
2007/0245972 A1 * 10/2007 Symons ..... A63C 19/06 119/255
2009/0030791 A1 * 1/2009 Chitturi ..... G06Q 30/02 705/14.16
2010/0035698 A1 * 2/2010 Burns ..... A63B 69/0057 473/274
2014/0231369 A1 * 8/2014 Goldstein ..... A63B 61/003 211/13.1

* cited by examiner

*Primary Examiner* — Raleigh W Chiu
(74) *Attorney, Agent, or Firm* — Tillman Wright, PLLC; James D. Wright; David R. Higgins

(57) ABSTRACT

A method of blocking tennis balls from one tennis court at a tennis facility from entering an adjacent tennis court. The method includes providing a vertical frame defining a front and a back, installing a removable panel on the frame, the vertical frame and the removable panel defining a temporary, removable, portable partition, temporarily placing the partition between a first tennis court and a second court at a tennis facility, the first and second tennis courts being adjacent to each other, via the partition, blocking a tennis ball played on the first tennis court from entering the second tennis court, and after play has concluded on the first tennis court, removing the partition from between the first and second tennis courts. The partition includes a hollow base having a fill port to receive water, sand, or another pourable, fungible substance for weighting the base and partition down.

5 Claims, 21 Drawing Sheets

FREE-STANDING TENNIS COURT PARTITION

CROSS-REFERENCE TO RELATED APPLICATION

The present application is a U.S. nonprovisional patent application of, and claims priority under 35 U.S.C. §119(e) to, U.S. provisional patent application Ser. No. 61/856,712, filed Jul. 21, 2013, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to tennis court accessories, and, in particular, to tennis court partitions.

Background

It is common that a tennis court area is surrounded with a peripheral wall with a plurality of tennis courts arranged therein just by drawing lines on the surface of the courts plus it is conventional that there is no partition wall serving as a boundary between one tennis court and another adjacent to it.

A tennis ball typically rebounds strongly without reduction of rebounding force after impact against the surface of the fence located rearward of the back line. If such a strong rebound of a tennis ball takes place just at the rear of the back line, the ball may conveniently return back near to the player. However, if the ball is sent obliquely to either side of the fence rearward of the back line and runs into such a side, the ball may rebound toward and onto the adjacent tennis court when there is no partition between the tennis courts adjacent to each other. As a result of this, the players on the offending court are obliged to interrupt their game to retrieve the errant ball. Moreover the play going on in the adjacent court is also obliged to be interrupted when the tennis ball comes running in the adjacent court or service area thereof. Such interruptions occur frequently, and as a result critical points must be replayed. There is a further possibility that a player may accidentally tread on a tennis ball coming from the other court, causing injury.

Hence, an aspect of the technology described herein is to provide for addressing this situation.

Related patents known in the art include the following U.S. Pat. No. 4,014,521, issued to Berman on Mar. 29, 1977; U.S. Pat. No. 4,116,436, issued to Bjorhn on Sep. 26, 1978; U.S. Pat. No. 4,290,602, issued to Kennedy on U.S. Pat. Nos. 4,290,602; 4,456,252, issued to Hartland on Jun. 26, 1984; U.S. Pat. No. 4,491,321, issued to Veenema on Jan. 1, 1985; U.S. Pat. No. 4,834,377, issued to Weiss on 1989; U.S. Pat. No. 4,941,663, issued to Walker on Jul. 17, 1990; U.S. Pat. No. 5,004,235, issued to Sugu on Apr. 2, 1991; U.S. Pat. No. 5,141,226, issued to Cavanagh on Aug. 25, 1992; U.S. Pat. No. 5,407,178, issued to Long on Apr. 18, 1995; and U.S. Pat. No. 5,482,269, issued to Scott et al. on Jan. 9, 1996.

SUMMARY OF THE PRESENT INVENTION

Broadly defined, the present invention according to one aspect is a tennis court facility utilizing a temporary tennis court partition to prevent balls played on one tennis court from entering another tennis court, including: a first tennis court and a second tennis court, the first and second tennis courts disposed next to each other; and a temporary, removable, portable partition disposed between the first and second tennis courts to block balls played on the first tennis court from entering the second tennis court, the partition including a vertical frame, and an advertising panel, removably supported by the vertical frame.

In a feature of this aspect, the vertical frame has a front side and a back side and wherein the advertising panel is a sleeve that is installed over a top of the vertical frame and covers the front and back sides of the vertical frame.

In another feature of this aspect, the frame includes a weighted base to prevent the partition from being blown or knocked over. In further features, the base is hollow and is temporarily filled with water, sand, or another pourable, fungible substance; the hollow base includes a fill port; and/or the fill port is covered by a removable cap.

In another feature of this aspect, the frame includes a base, two vertical columns extending upward from the base, and a cross member extending from tops of the vertical columns, wherein each column includes a cylindrical portion attached to a rectilinear portion, and wherein the cylindrical portion and rectilinear portion each interface with the base. In a further feature, the base includes a cylindrical pedestal and a rectilinear pedestal for each column, wherein a lower end of the cylindrical portion of each column is hollow and rests on a respective cylindrical pedestal, and wherein a lower end of the rectilinear portion of each column is hollow and rests on a respective rectilinear pedestal.

In another feature of this aspect, the frame includes a base, two vertical columns extending upward from the base, and a cross member extending from tops of the vertical columns, wherein each column includes a cylindrical portion attached to a rectilinear portion, and wherein the cylindrical portion and rectilinear portion each interface with the cross member. In a further feature, the cross member includes a cylindrical opening and a rectilinear opening for each column, wherein an upper end of the cylindrical portion of each column is inserted into a respective cylindrical opening, and wherein an upper end of the rectilinear portion of each column is inserted into a respective rectilinear opening.

In another feature of this aspect, the frame includes a base, two vertical columns extending upward from the base, and a cross member extending from tops of the vertical columns, wherein the base is flared outward and downward from the vertical columns to provide improved support.

In another feature of this aspect, the tennis court facility further includes a fence extending along the first and second tennis courts, wherein the partition is temporarily disposed adjacent the fence and angled relative thereto. In a further feature, the fence is a first fence, wherein the partition is a first partition, wherein the tennis court facility further comprises a second fence extending along the first and second tennis courts opposite the first fence, and wherein the tennis court facility further comprises a second partition that is similar to the first partition and is temporarily disposed adjacent the second fence and angled relative thereto.

In another feature of this aspect, the sleeve includes perforations or other openings to permit airflow therethrough.

In another feature of this aspect, the sleeve includes indicia displayed thereon.

In another feature of this aspect, the partition includes a hollow base, flared outward and downward, having a fill port to receive water, sand, or another pourable, fungible substance for weighting the base and partition down, wherein the vertical frame includes two columns and a cross member extending across tops of the two columns, wherein the frame defines front and back sides, and wherein the advertising panel is a hollow sleeve, displaying indicia thereon, that is installed down over the cross member and columns so as to cover the front and back sides of the frame.

Broadly defined, the present invention according to another aspect is a temporary, removable, portable partition adapted to be disposed between two tennis courts to block balls played on one court from entering the other court, including: a hollow base, flared outward and downward, having a fill port to receive water, sand, or another pourable, fungible substance for weighting the base and partition down; a vertical frame, including two columns and a cross member extending across tops of the two columns, the frame defining front and back sides; and a hollow sleeve, displaying indicia thereon, that is installed down over the cross member and columns so as to cover the front and back sides of the frame.

Broadly defined, the present invention according to another aspect is a method of blocking tennis balls from one tennis court at a tennis facility from entering an adjacent tennis court at the same facility, including: providing a vertical frame defining a front and a back; installing a removable panel on the frame, the vertical frame and the removable panel defining a temporary, removable, portable partition; temporarily placing the partition between a first tennis court and a second court at a tennis facility, the first and second tennis courts being adjacent to each other; via the partition, blocking a tennis ball played on the first tennis court from entering the second tennis court; and after play has concluded on the first tennis court, removing the partition from between the first and second tennis courts.

In a feature of this aspect, the method further includes a step, after removing the partition from between the first and second tennis courts, of removing the removable panel from the frame.

In another feature of this aspect, the removable panel is an advertising panel, and wherein the method further comprises displaying one or more advertising indicia thereon. In further features, the step of displaying one or more advertising indicia includes displaying one or more advertising indicia commemorating a facility, an event, an organization or a sponsor; the step of displaying one or more advertising indicia includes displaying one or more advertising indicia including a web site address; the step of displaying one or more advertising indicia includes displaying one or more advertising indicia including a telephone number; and/or the step of displaying one or more advertising indicia includes displaying one or more advertising indicia including an email address.

In another feature of this aspect, the step of providing a vertical frame includes providing a base in conjunction with two vertical columns and a cross member. In further features, the step of installing a removable panel on the frame includes installing the panel over a top of the vertical frame and covers the front and back sides of the vertical frame; and/or the step of providing a base includes providing a hollow base with a fill port, and wherein the method further comprises filling the hollow base, via the fill port, with water, sand, or another pourable, fungible substance.

In another feature of this aspect, the step of installing a removable panel on the frame includes installing a sleeve over the frame.

In another feature of this aspect, a fence extends behind a respective baselines of the first and second tennis courts, and wherein the step of temporarily placing the partition between the first tennis court and the second court includes placing the partition adjacent the fence behind the baselines.

Broadly defined, the present invention according to another aspect is a free-standing tennis court partition as shown and described.

Broadly defined, the present invention according to another aspect is a free-standing tennis court partition, including: a frame, having a base, a plurality of columns extending upward from the base, and a cross member, connecting upper portions of the columns; and a sleeve extending over the frame.

In a feature of this aspect, the sleeve include structural features to which a sign may be attached. In a further feature, the structural features include a strip of hook and loop material.

In a further feature of this aspect, a sign is temporarily attached to a face of the sleeve.

Broadly defined, the present invention according to another aspect is a free-standing tennis court partition, including: a frame, having a hollow base, a plurality of columns extending upward from the base, and a cross member, connecting upper portions of the columns; and a covering extending over the frame.

In a feature of this aspect, the covering extends only over once face of the frame.

In another feature of this aspect, the base has a fill port.

In another feature of this aspect, the base is temporarily filled with a weighted material. In further features, the base is temporarily filled with water and/or sand.

Broadly defined, the present invention according to another aspect is a system for deterring tennis balls from going to an adjacent court including: a support device comprising a frame configured to stand upright on a planar surface wherein the frame is comprised of a plurality of tubular material components dimensioned to friction fit into each corresponding component to form a hollow rectangular shape having a top portion, a bottom portion and two opposing side portions connecting the top portion to the bottom portion, each of the two opposing side portions extending downward beyond the bottom portion towards the planar surface to form at least one planar surface contact point, each planar surface contact point having a planar surface foot attached thereon, the planar surface foot configured to have a non skid surface, creating an air gap between the planar surface and the bottom portion, wherein the air gap is slightly less than the height of a standard tennis ball; a water resistant air-permeable covering configured to attach to the support device and form a barrier over the hollow of the frame to a tennis ball striking the barrier, the air-permeable covering permitting the flow of air up to 20 miles per hour without destabilizing the support structure, wherein the covering has indicia disposed thereon; at least one of a transparent sleeve configured for insertion of a placard, the transparent sleeve affixed on the air-permeable covering; at least one connector attached to the support device and configured to releasably attach the support device to a tennis court fence positioned behind a base line of a tennis court; and at least one hinge attached to the support device, configured to allow the support device to pivot horizontally on the planar surface, the at least one hinge connected to the tennis court fence.

In a feature of this aspect, a method for deterring tennis balls from going from a first tennis court to an adjacent tennis court includes attaching the system to a first tennis court distal baseline fence approximately halfway between the first tennis court and the adjacent tennis court; attaching the system to a first tennis court proximal baseline fence approximately halfway between the first tennis court and the adjacent tennis court, and inserting a placard into each transparent sleeve.

Broadly defined, the present invention according to another aspect is a device for deterring tennis balls from going to an adjacent court including: a support for a standing on a tennis court surface, and a covering disposed on the support.

In a feature of this aspect, the support further includes a one-piece frame configured to stand upright on a planar surface and having a space beneath the frame and above the tennis court surface, the space having a height less than the height of a regulation tennis ball. In further features, the covering further includes a water resistant air permeable covering configured to attach to the support device; the covering has indicia disposed thereon; the device further includes one or more connectors configured to releasably attach the support to a tennis court baseline fence; the device further includes one or more of a hinge attaching the support to the tennis court baseline fence; the covering further includes one or more of a transparent sleeve dimensioned for insertion of a sheet of material conveying event information; the indicia commemorates a facility, an event, an organization or a sponsor; the indicia is a web site address; the indicia is a telephone number; and/or the indicia is an email address.

Broadly defined, the present invention according to another aspect is a temporary tennis court partition as shown and described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
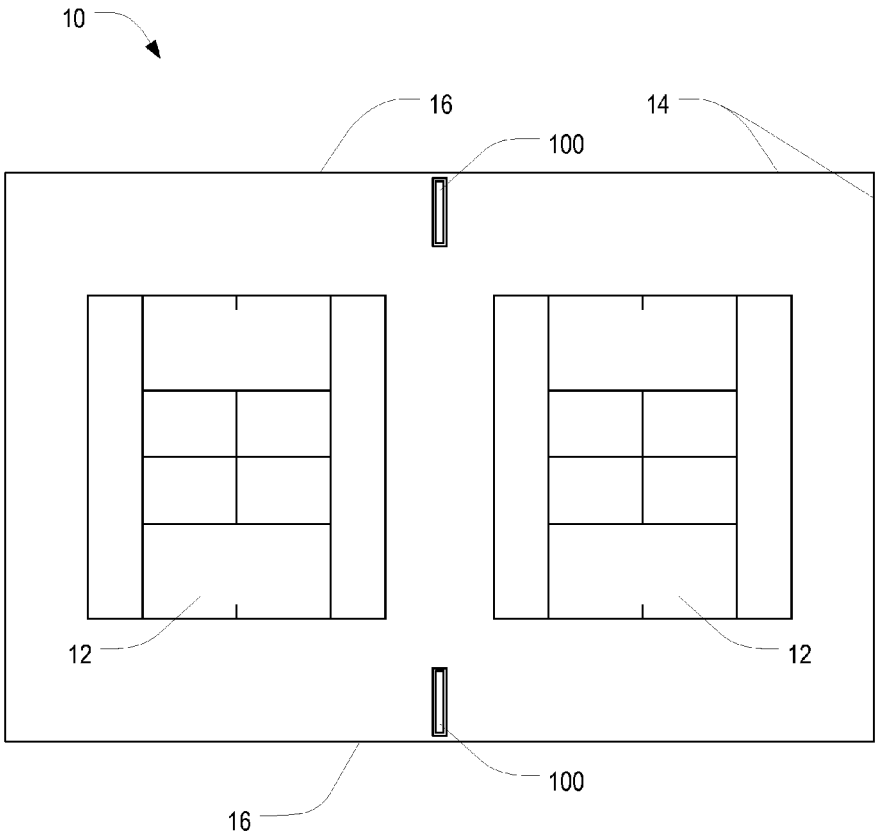
FIG. 1 is a top schematic view of a tennis court facility employing two free-standing tennis court partitions in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a top schematic view of a tennis court facility 10 employing two free-standing tennis court partitions 100 in accordance with one or more preferred embodiments of the present invention. As shown therein, the tennis court facility 10 includes two adjacent courts 12 that are jointly surrounded by a fence 14. The construction of the courts 12 and fence 14 may be conventional in nature. Notably, in at least some embodiments, the fence 14 does not include any portion extending between the two courts 12 themselves. However, two free-standing tennis court partitions 100 are shown installed near the back fences 16 that extend behind the baselines of the two tennis courts 12.

Figure 2:
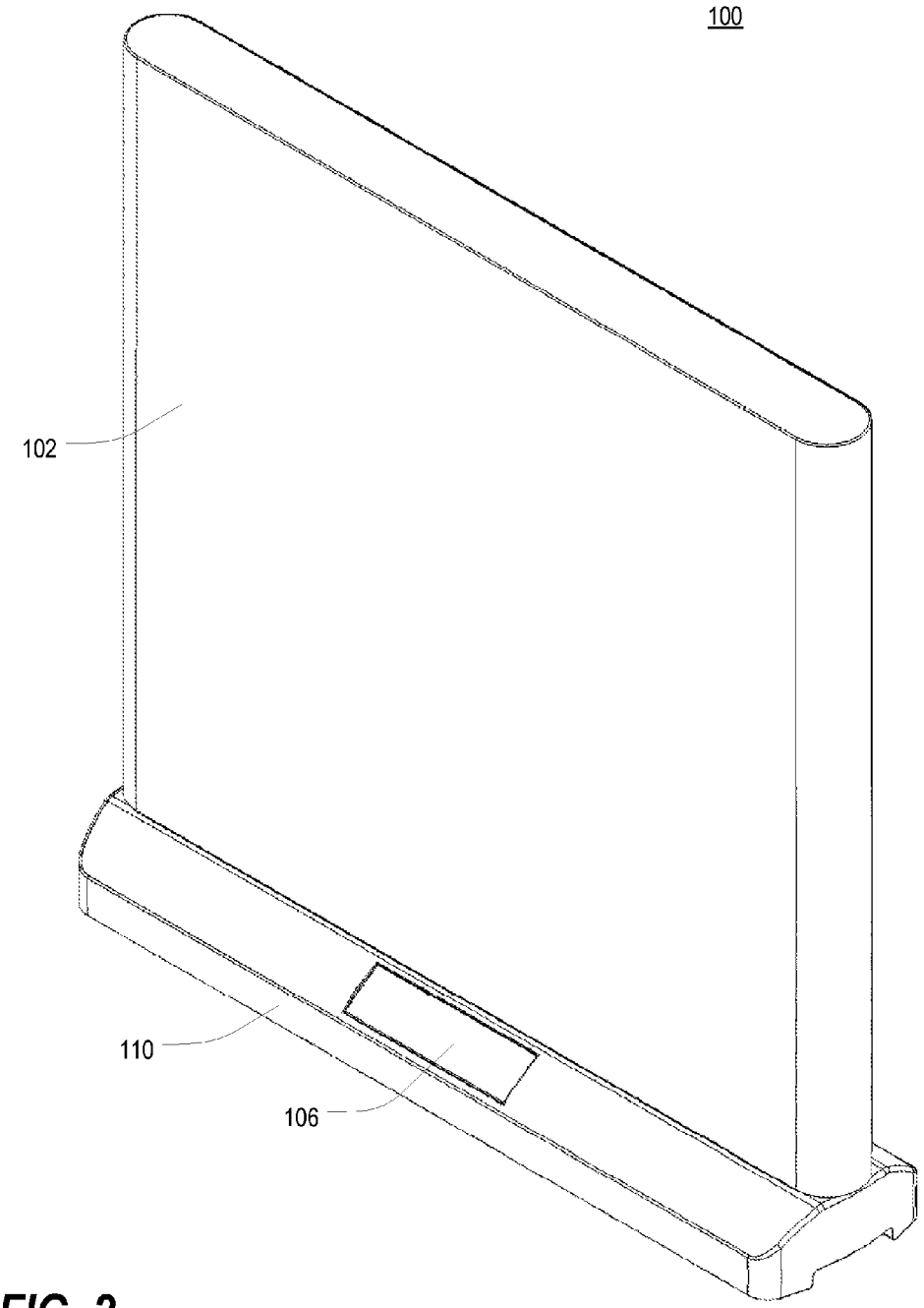
FIG. 2 is an isometric view of one of the free-standing tennis court partitions of FIG. 1.
Figure 3:
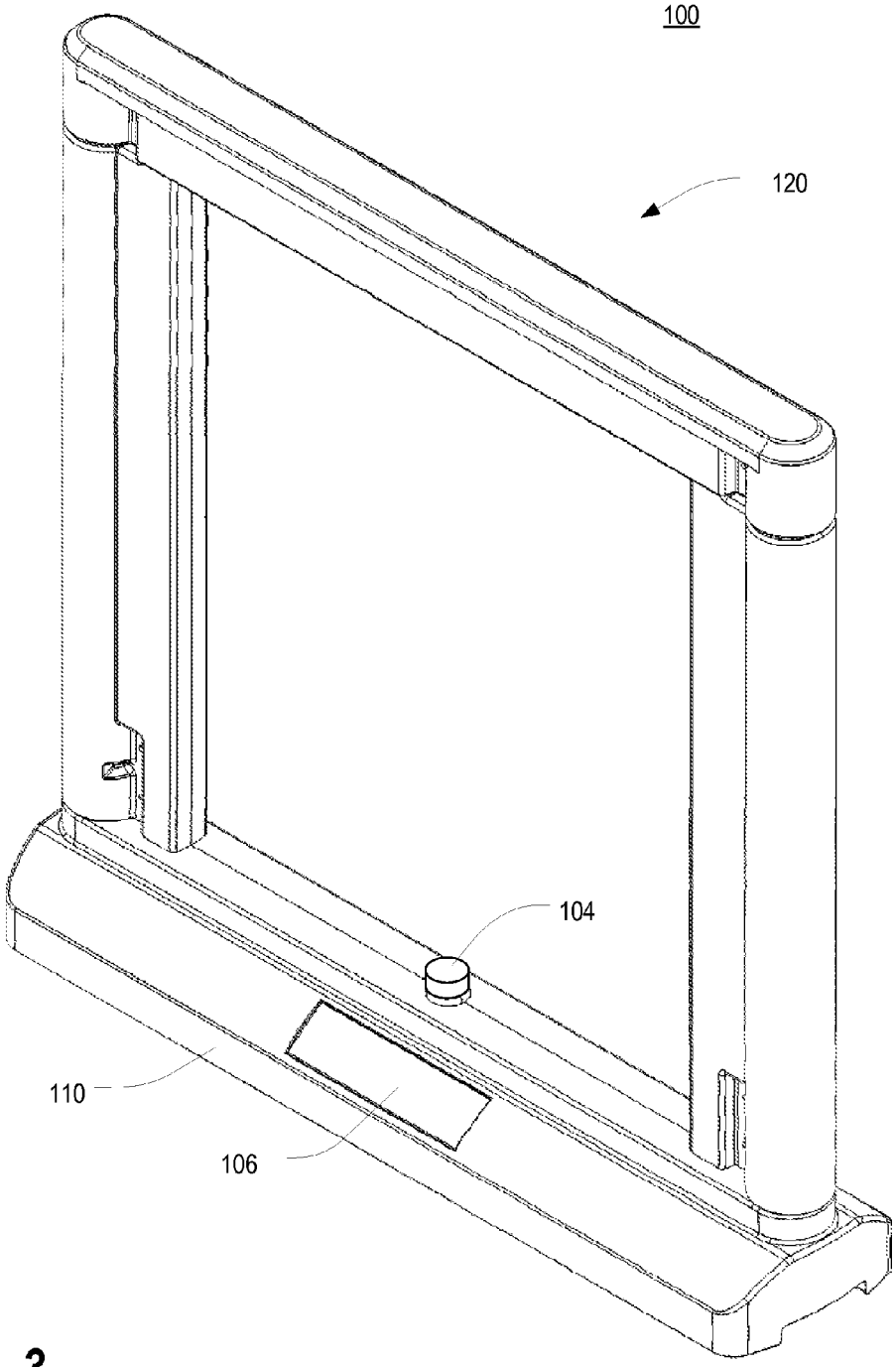
FIG. 3 is an isometric view of the tennis court partition of FIG. 2, shown with the sleeve removed.

FIG. 2 is an isometric view of one of the free-standing tennis court partitions 100 of FIG. 1, and FIG. 3 is an isometric view of the tennis court partition 100 of FIG. 2, shown with the sleeve 102 removed. As shown therein, the tennis court partition 100 includes a base 110, a frame 120, and a sleeve or other cover 102 installed over the frame 120.

Figure 4A:
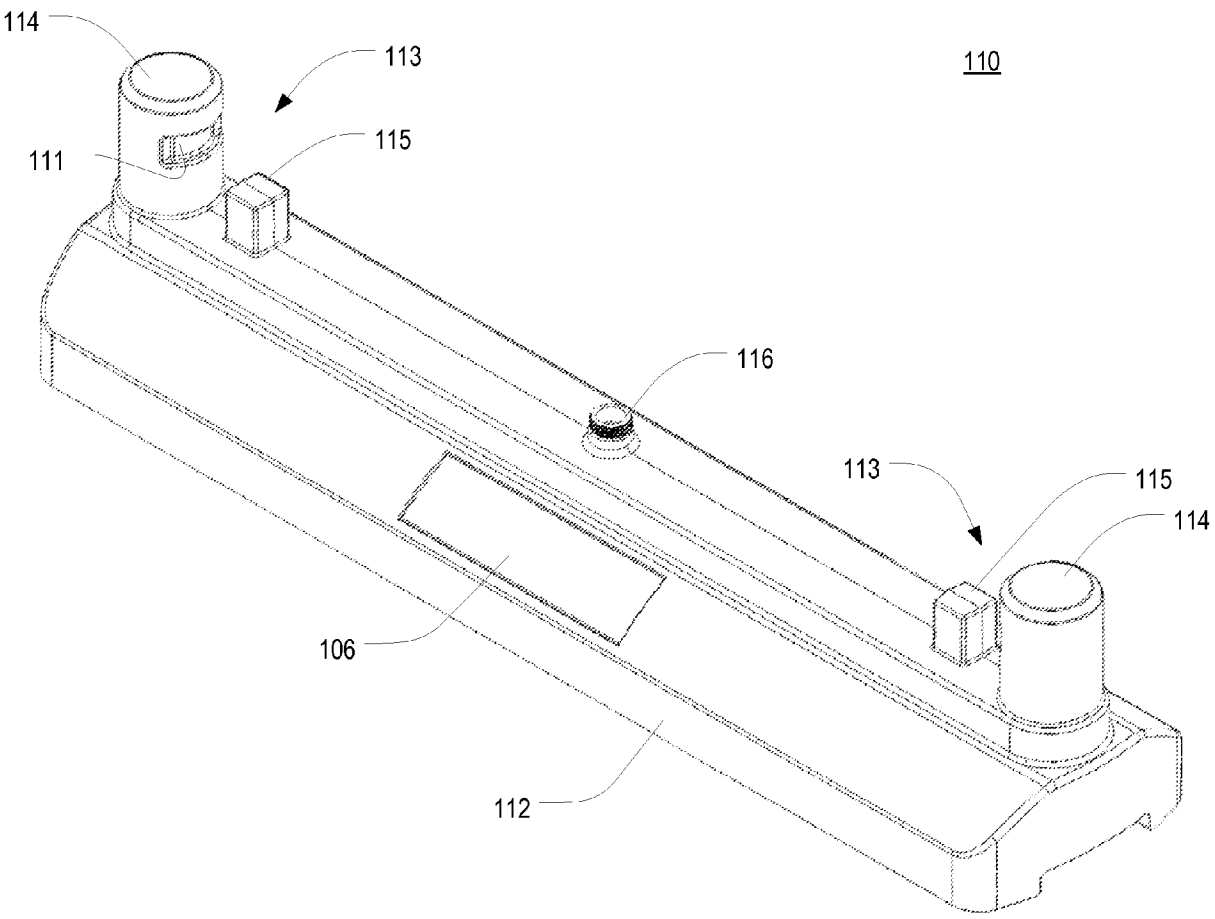
FIGS. 4A and 4B are an isometric view and a front view, respectively, of the base of FIGS. 2 and 3.
Figure 4B:
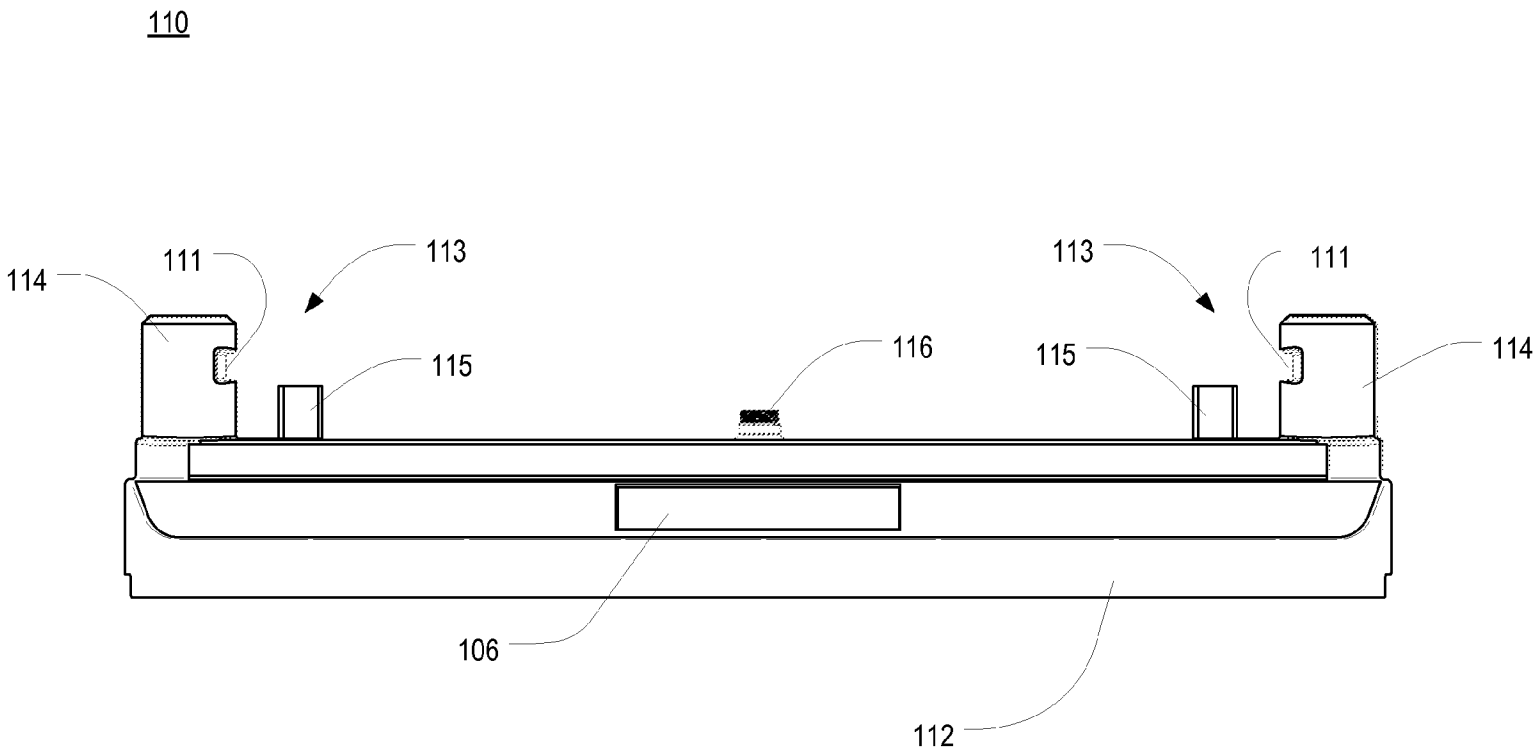

FIGS. 4A and 4B are an isometric view and a front view, respectively, of the base 110 of FIGS. 2 and 3. The base 110 includes a main body 112, a pair of double pedestal structures 113, and a fill port 116. The double pedestal structures 113 each include a cylindrical pedestal 114 and a smaller square pedestal 115 extending upward from the top of the main body 112 and are designed to interconnect with the columns 122 as described further below. The main body 112 itself is hollow to accommodate a quantity of water, sand, or other inexpensive, easily obtainable, weighted material suitable for maintaining the main body 112, and thus the partition 100 as a whole, in an upright position when the frame 120 and sleeve 102 are installed thereon, even when the partition 100 is subjected to wind, struck balls, contact with tennis players, and the like. The weighted material may be loaded into the hollow main body 112 via the fill port 116, which is preferably threaded to receive a correspondingly-threaded cap 104 (shown in FIG. 3). Although the fill port 116 is shown as being in the middle of the top surface of the base 110, a fill port could alternatively or additionally be located elsewhere, such as at the end of the base 110. The main body 112 may also include a pair of flat areas 106 (one shown) for accommodating a brand, logo, or the like, which may be applied via molding, engraving, separate adhesive strip, or the like.

Figure 5A:
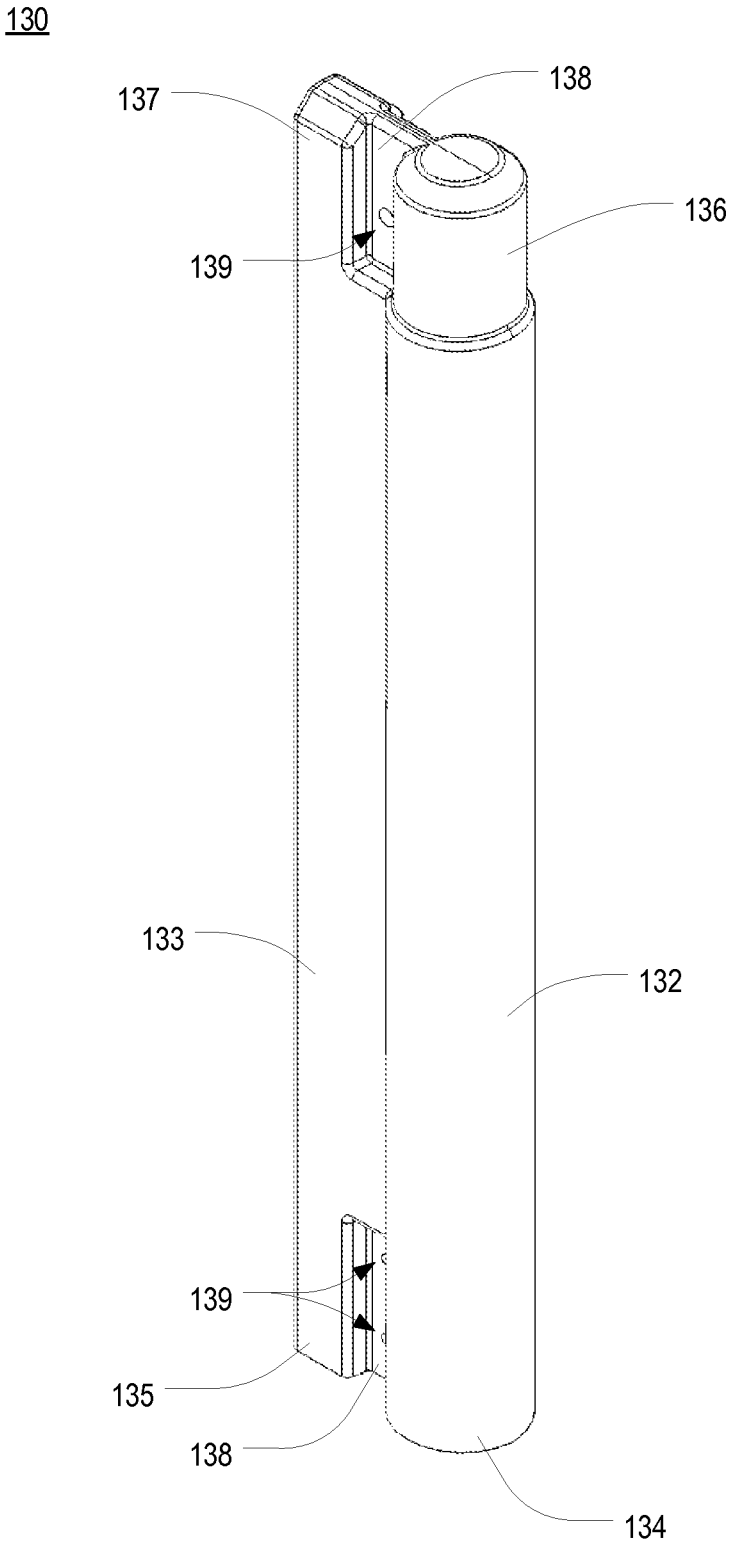
FIGS. 5A and 5B are an isometric view and a front view, respectively, of one of the columns of the frame of FIG. 3.
Figure 5B:
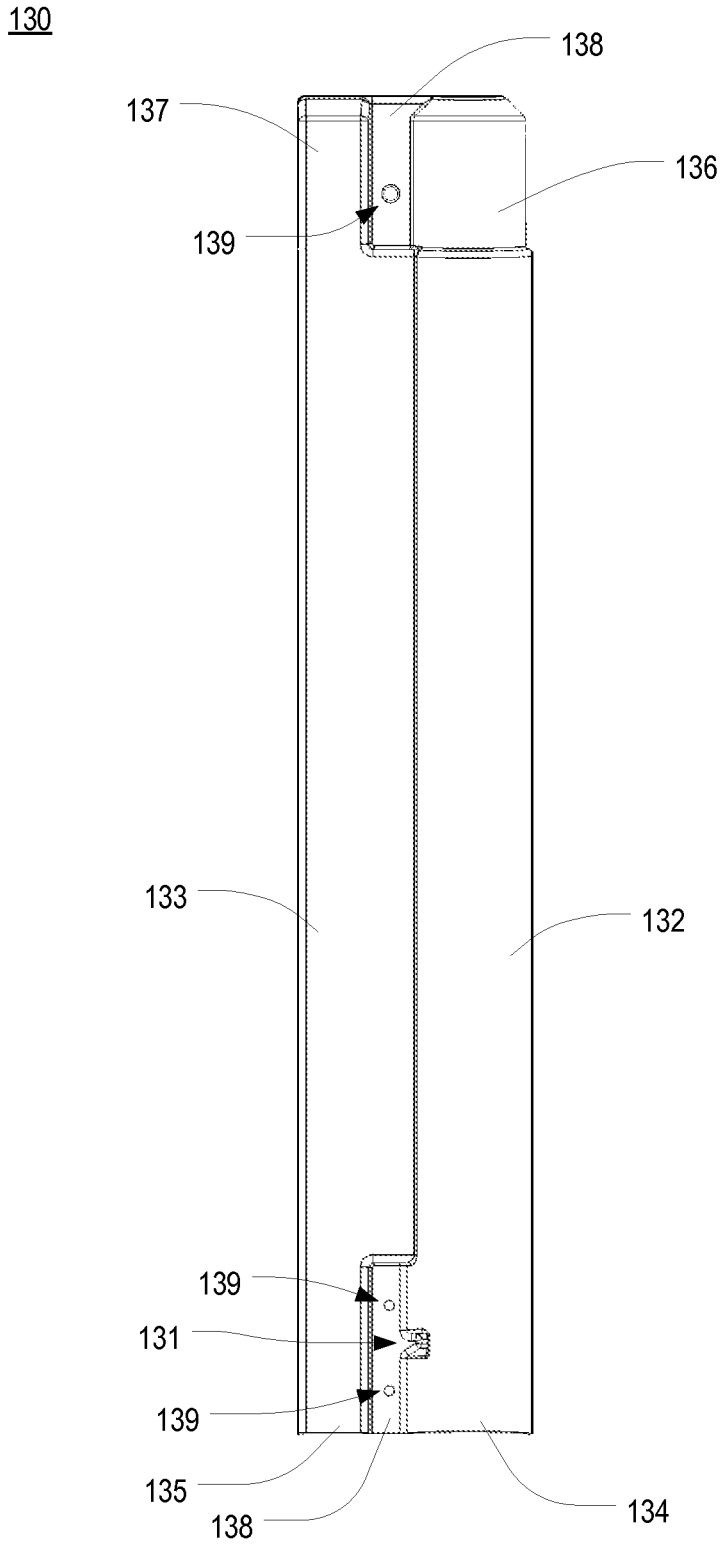
Figure 6A:
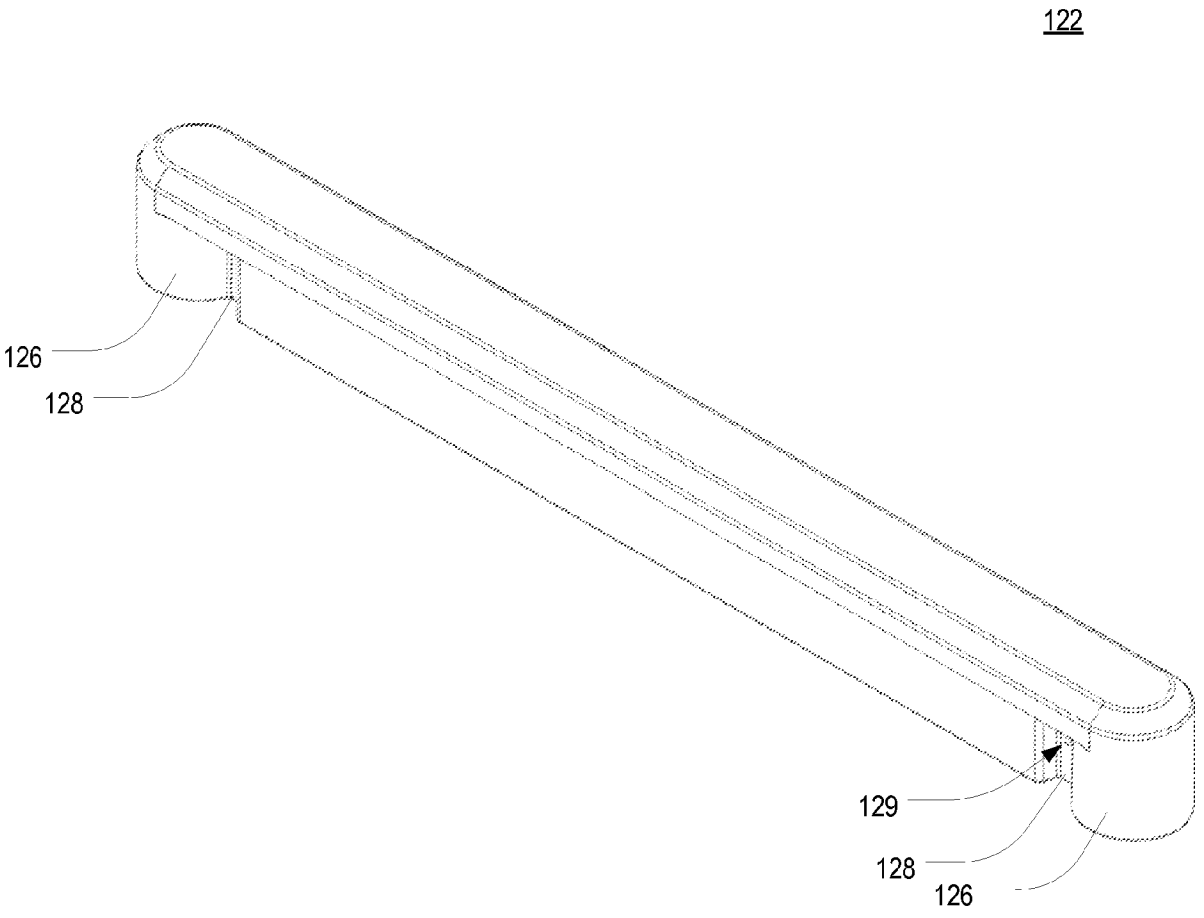
FIGS. 6A and 6B are an isometric view and a bottom view, respectively, of the cross member of the frame of FIG. 3.
Figure 6B:
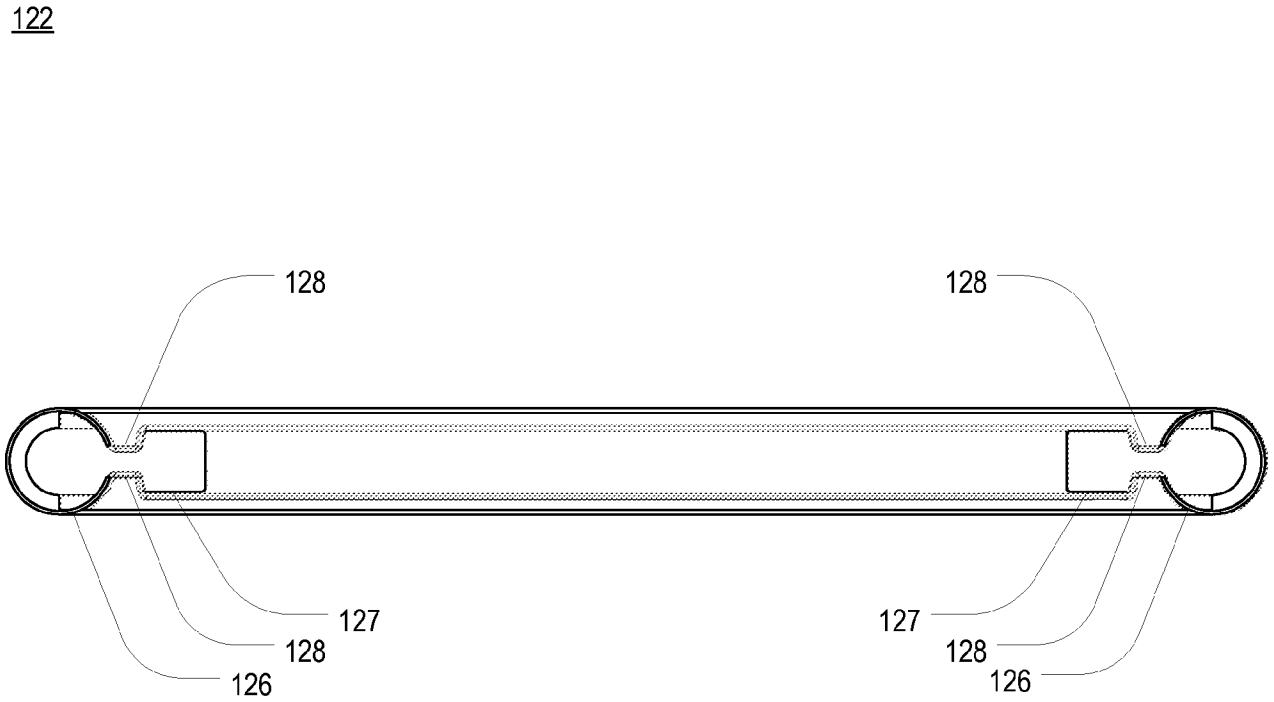

The frame 120 includes two columns 130 and a cross member 122. FIGS. 5A and 5B are an isometric view and a front view, respectively, of one of the columns 130 of the frame 120 of FIG. 3, and FIGS. 6A and 6B are an isometric view and a bottom view, respectively, of the cross member 122 of the frame 120 of FIG. 3. Each column 130 includes an elongated cylindrical portion 132 and a square portion 133 running the length of the cylindrical portion 132. Recesses 138 having molded or drilled apertures 139 therein may also be provided, such as between the upper end of the cylindrical portion 132 and the upper end of the square portion 133, and between the lower end of the cylindrical portion 132 and the lower end of the square portion 133. The lower end of each of the cylindrical portion 132 and the square portion 133 is preferably hollow so as to form a respective female fitting 134,135 that fits over and around a corresponding pedestal 114,115 on the main body 112 of the base 110. The upper end of each of the cylindrical portion 132 and the square portion 133 comprises a respective male fitting 136,137 adapted to fit into a respective corresponding downward-oriented female fitting 126,127 in the bottom of the cross member 122 (shown in FIG. 6B). In other words, each end of the cross member 122 includes a cylindrical female fitting 126 and a square female fitting 127 sized to accommodate the upper ends 136,137 of the cylindrical portion 132 and the square portion 133, respectively, of one of the columns 130. As with the frame columns 130, recesses 128 having molded or drilled apertures 129 therein may be provided, such as between the each cylindrical female fitting 126 and the adjacent square female fitting 127.

In some embodiments, at least some of the respective female fittings 126,127,136,137 may be snap-fit into place for easy assembly and disassembly, but other constructions may alternatively or additionally be utilized. In the illustrated embodiment, snap-fitting between the columns 130 and the base 110 is facilitated via a notch 111 in each of the two cylindrical pedestals 114 on the base 110 and a corresponding feature 131 in the wall of the bottom of the cylindrical portion 132 of each column 130.

Figure 7:
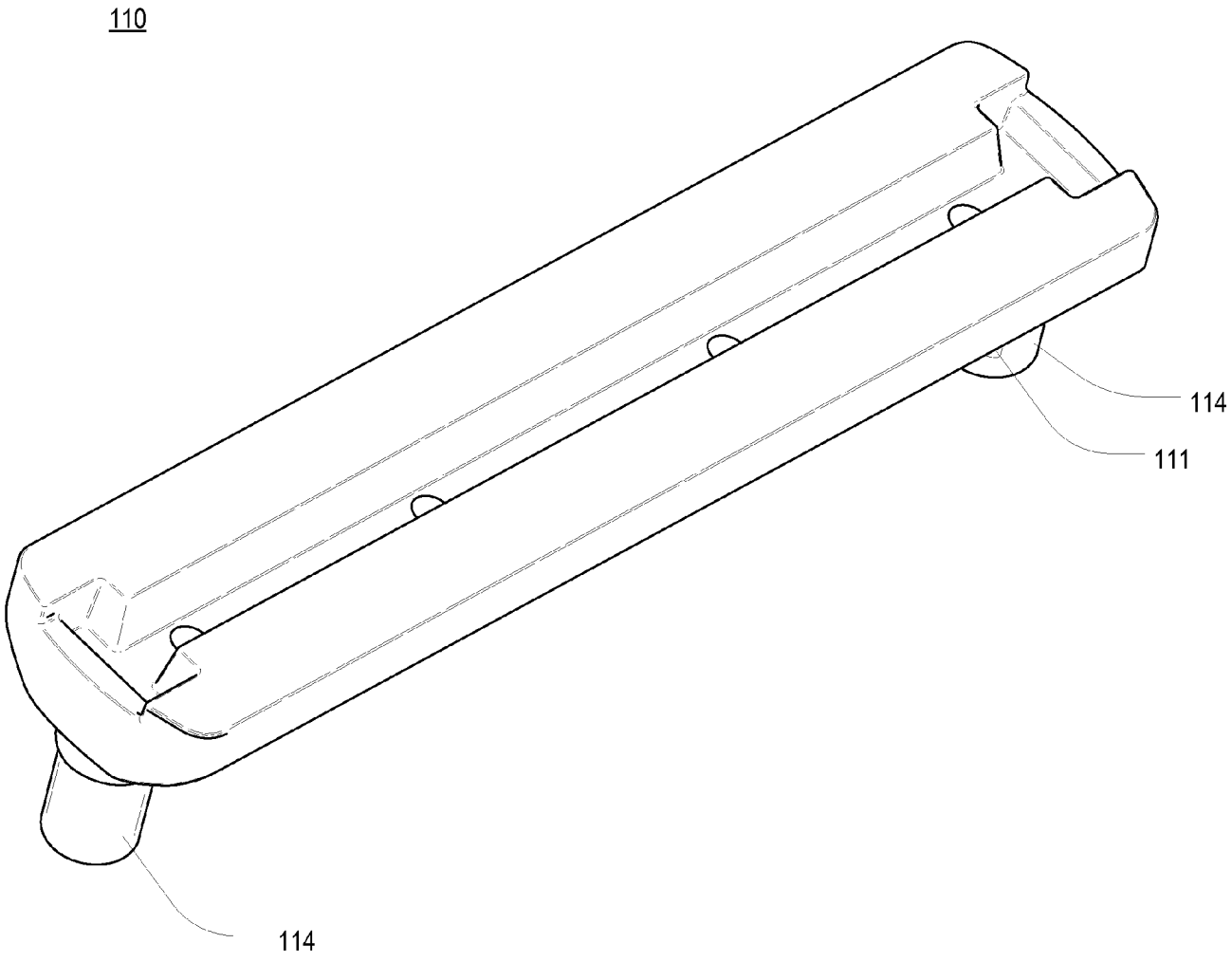
FIGS. 7, 8, and 9 are orthogonal bottom views of the base, one of the columns, and the cross member, illustrating additional structural features thereof.
Figure 8:
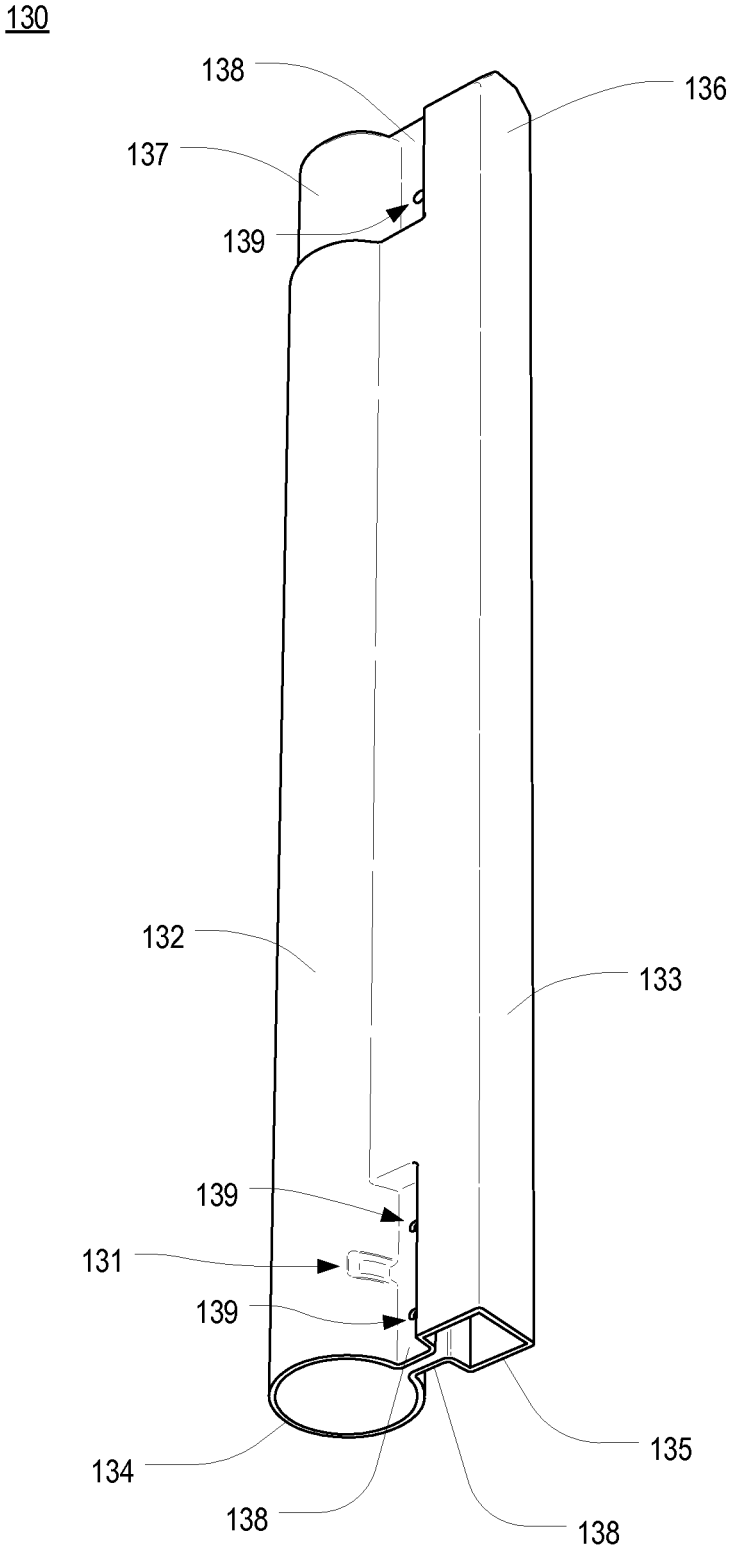
Figure 9:
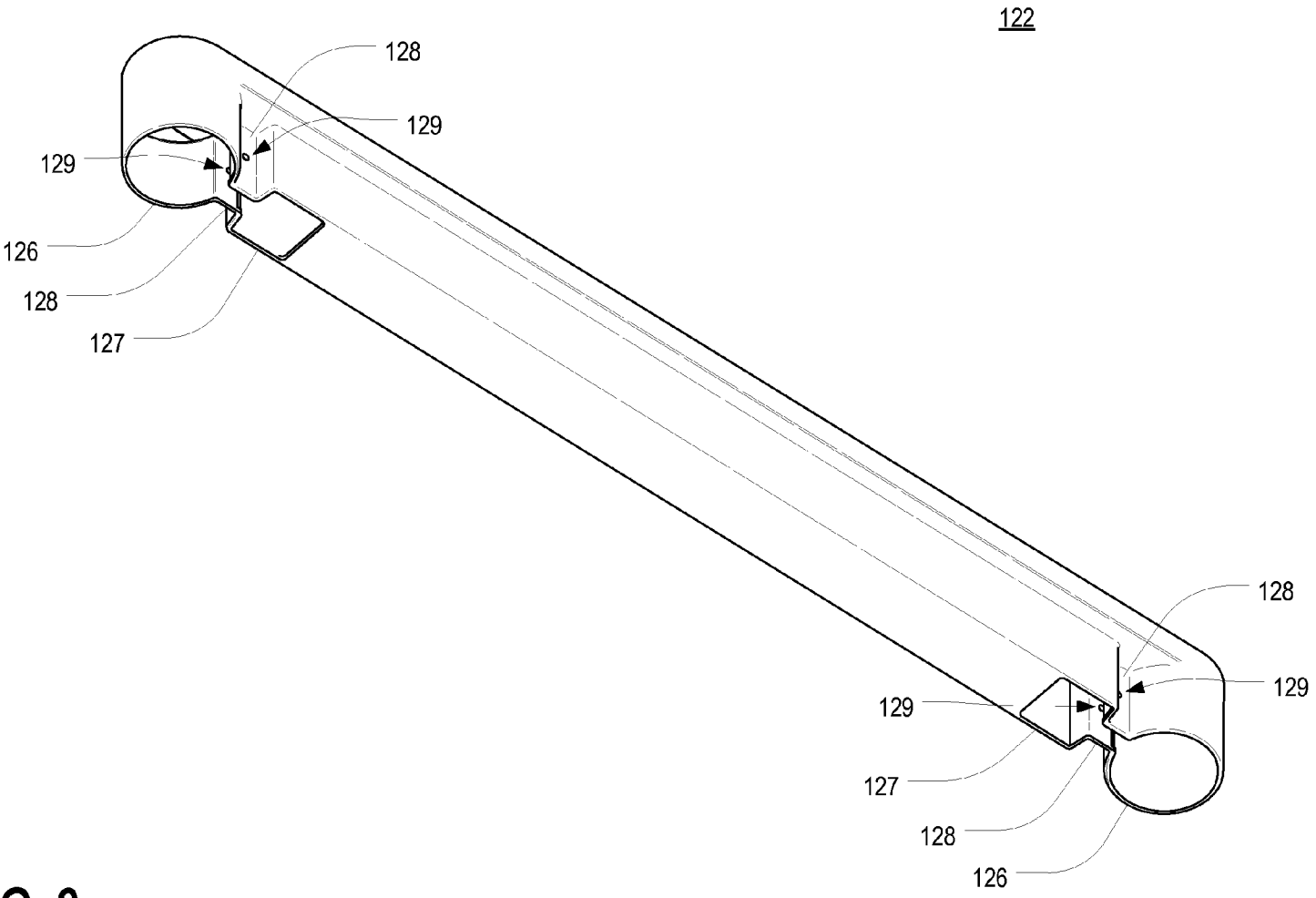

FIGS. 7, 8, and 9 are orthogonal bottom views of the base 110, one of the columns 130, and the cross member 122, respectively, illustrating additional structural features thereof. In some embodiments, the joints between the columns 130 and the base 110, the joints between the cross member 122 and the columns 130, or both, may be secured via fasteners (not shown) of various types. In the illustrated embodiment, the columns 130 may be clamped to the pedestals 114,115 of the base 110 by inserting fasteners through the apertures 139 in the lower recesses 138 and tightening them, thereby pulling opposing walls of the lower end of each column 130 toward each other. Although not shown, fasteners may additionally or alternatively be used to fasten the columns 130 directly to the pedestals 114,115. Also in the illustrated embodiment, the cross member 122 may be attached to the columns 130 by inserting fasteners (not shown) through the apertures 129 in the recesses 128 of the cross member 122 and through corresponding apertures 139 in the upper recesses 138 of the columns 130. Although not shown, fasteners may additionally or alternatively be used to clamp the cross member 122 to the tops of the columns 130.

In at least some embodiments, the elements of the frame 120 are constructed using rotational molding. In one contemplated commercial embodiment, the base 110 (and thus the partition 100 as a whole) is 54 inches long and 12 inches wide, the columns 130 are approximately 47 inches high, and the overall height of the partition 100 is 54 inches. These dimensions are thought to provide a good balance between the percentage of tennis balls that are blocked and the overall impedance the partition 100 provides and its ease of use.

Figure 10:
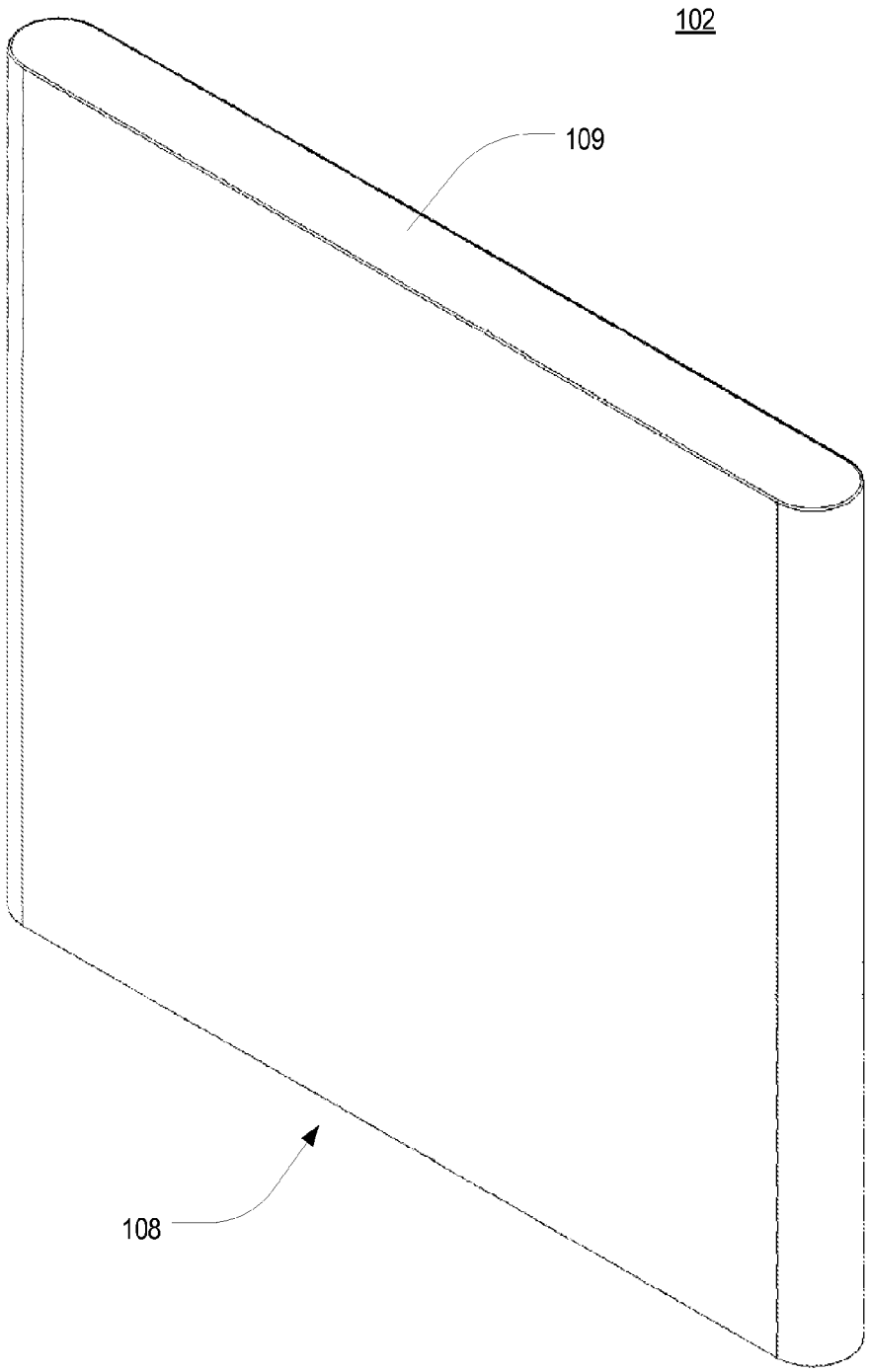
FIG. 10 is an isometric view of the sleeve of FIG. 2.

To prepare the tennis court partition 100 for use, the base 110, columns 130, and cross member 122 are assembled as described above to produce the frame 120 shown in FIG. 3. The base 100 is filled with water, sand, or the like using the fill port 116, and the cap 104 is replaced. A selected sleeve 102 is installed over the assembled frame 120 by pulling an open lower end 108 over the top of the frame 120 and pulling the sleeve 102 downward until the upper end 109 of the sleeve 102 is seated on the top of the frame 120. FIG. 10 is an isometric view of the sleeve 102 of FIG. 2. The sleeve 102 is preferably sized to fit relatively snugly over the frame 120, but not so tightly that it cannot be readily removed, and to extend to exactly or close to the top of the base 110 when fully seated on the frame 120. In some embodiments, the sleeve 102 is made from mesh or otherwise includes holes or openings to lessen wind resistance, but in other embodiments, the sleeve 102 does not have such openings. The sleeve 102 is preferably made from a material that will stand up to wind, rain, and other environmental elements. One material suitable for use is polyester.

In at least some embodiments, the sleeve 102 is adorned with artwork in the form of a tennis club, facility or tournament brand, school name or logo, corporate sponsor (third party product brand or other) brand, or other readable information (such as informational signs).

In one embodiment (not illustrated), the sleeve includes structural features, such as hook and loop elements, grommets, or the like, to which a more easily removable sign may be removably attached via corresponding structural features of its own. The removable signs may be adorned with artwork of the type described above. In this way, it may be possible to change the artwork shown on the tennis court partitions without preparing an entirely new sleeve.

Advantageously, when a tennis match is being played, the free-standing tennis court partition 100 helps prevent tennis balls from rolling or bouncing from the court 12 that the tennis match is being played on to adjacent courts 12. When positioned in one of the locations shown in FIG. 1, the partition 100 specifically helps prevent this from happening along the area of the back fences 16 of the tennis court 12, but it will be appreciated that the partition 100 can be placed elsewhere as well. This is particularly important on tennis courts 12, a large number of which exist and are in regular use today, that have only a fence 14, and no side partition, along the backs thereof.

Notably, the weight that exists when water or sand is put into the base 110 creates enough overall weight for the assembly so that the assembly does not have to be connected to the back fence 16 in any way. By not being connected to the fence 16, the assembly is a free standing unit and can be moved when maintenance of the courts 12 (i.e. sweeping, watering) is being done. The free standing unit also allows for moving the partition 100 from one court 12 to another if needed for any reason (for example, if a limited number of partitions 100 are available and it is desired to use the partitions 100 on various different courts 12, or for tournaments or special events) and for easily removing the unit during the winter season if needed.

Overall, the tennis court partition 100 of the present invention prevents balls from rolling or bouncing from one court 12 to another. This enhances the tennis match experience by reducing interruptions (due to fewer "lets" being called and points having to be replayed) and reducing match length. It also enhances the experience of tennis lessons and clinics because teaching professionals and players do not have to pick up balls on adjacent courts 12. Furthermore, tennis facilities have the opportunity for branding their facility, school, corporate sponsors, or the like by having their logos placed on the sleeve 102 of the assembly, or on signs mounted thereon.

Figure 11:
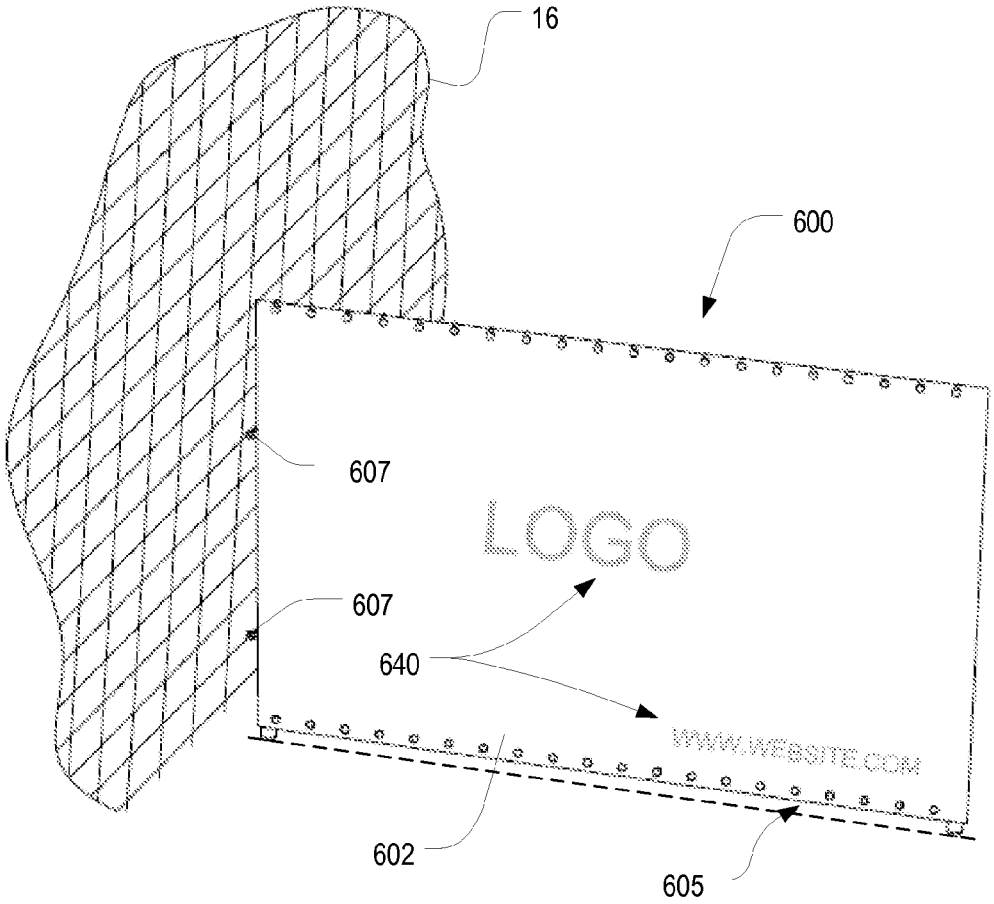
FIG. 11 is a fragmentary perspective view of a free-standing tennis court partition, attached to a fence, for deterring tennis balls from going from one court into an adjacent court, all in accordance with one or more preferred embodiments of the present invention.
Figure 12:
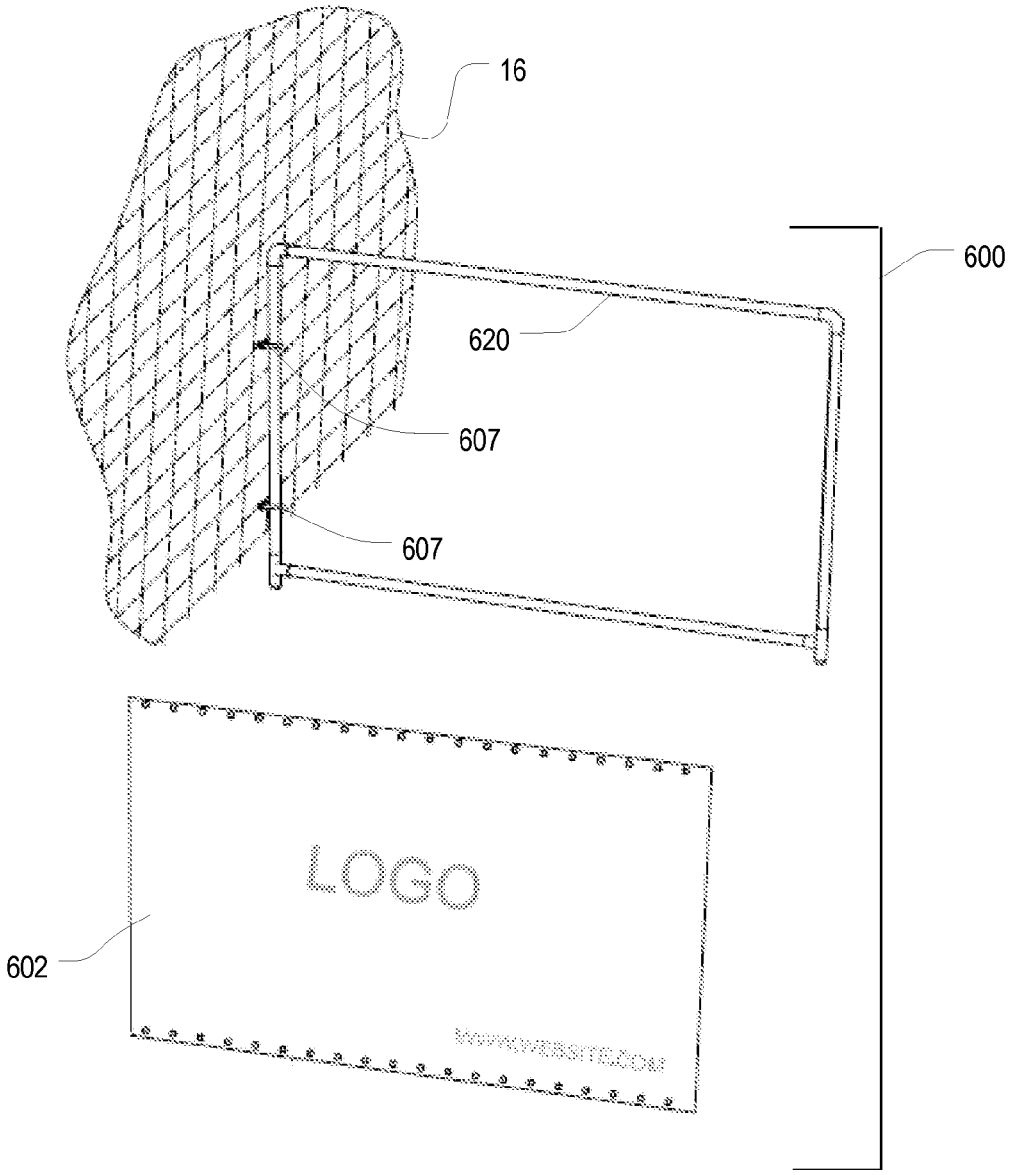
FIG. 12 is a partially exploded fragmentary perspective view of the covering removed from the frame of FIG. 11.
Figure 13:
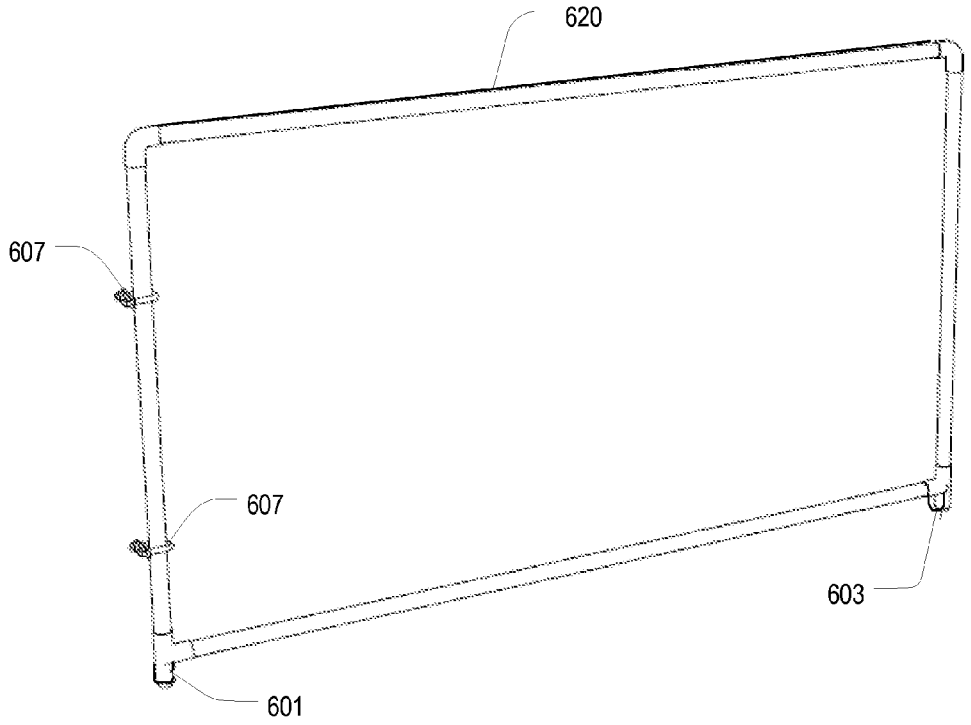
FIG. 13 is a perspective view of the frame of FIG. 12.
Figure 14:
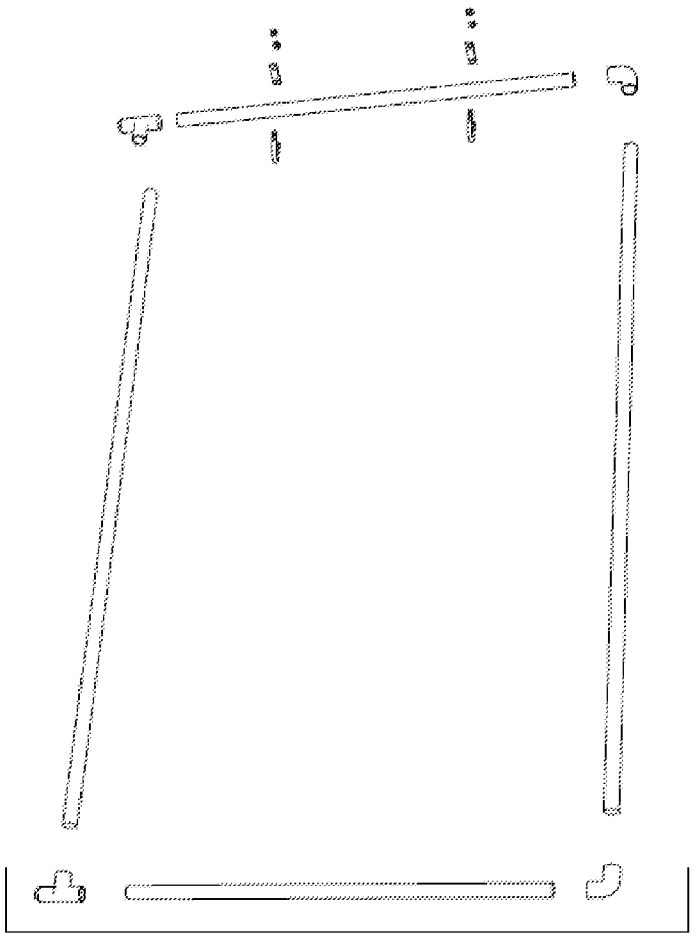
FIG. 14 is an exploded perspective of the frame of FIG. 13.

Other free-standing tennis court partitions are also possible. For example, FIG. 11 is a fragmentary perspective view of a free-standing tennis court partition 600, attached to a fence 16, for deterring tennis balls from going from one court 12 into an adjacent court 12, all in accordance with one or more preferred embodiments of the present invention, and FIG. 12 is a partially exploded fragmentary perspective view of the covering 602 removed from the frame of FIG. 11. As shown therein, the free-standing tennis court partition 600 comprises a frame 620 and a covering 602. The partition 600 is configured to stand upright on a planar surface wherein the frame 620 is comprised of a plurality of tubular material components dimensioned to friction fit into each corresponding component to form a hollow rectangular shape. FIG. 13 is a perspective view of the frame 620 of FIG. 12, and FIG. 14 is an exploded perspective of the frame 620 of FIG. 13. As shown therein, the frame 620 includes a top portion, a bottom portion and two opposing side portions connecting the top portion to the bottom portion, each of the two opposing side portions extending downward beyond the bottom portion towards the planar surface to form at least one planar surface contact point, each planar surface contact point having a planar surface foot 601 attached thereon, the planar surface foot 601 configured to have a non-skid surface 603, creating an air gap 605 between the planar surface and the bottom portion, wherein the air gap 605 (shown in FIG. 11) is slightly less than the height of a standard tennis ball (not shown). The covering 602 may be a water resistant air-permeable covering 602 configured to attach to the frame 620 and form a barrier over the hollow of the frame to a tennis ball striking the barrier, the air-permeable covering 602 permitting the flow of air up to 20 miles per hour without destabilizing the support structure, wherein the covering has indicia 640 disposed thereon, a transparent sleeve (not shown) configured for insertion of a placard, or both. If used, the transparent sleeve may be affixed on the air-permeable covering 602. The frame 620 may be attached to a tennis court fence 16 via a fence connector 107 attached to the frame 620 and configured to releasably attach the frame 620 to the tennis court fence 16 positioned behind a base line of a tennis court 12 (or elsewhere), such as is shown in FIG. 1. A hinge may further be attached to the frame 620, configured to allow the frame 620 to pivot horizontally on the planar surface, the at least one hinge connected to the tennis court fence 16.

In this embodiment, the partition 600 deters tennis balls from rolling from one court 12 into another court 12, and comprises a windscreen-like material 602, tubing that creates an outer frame 620 for this material 602, and a clip 607 that attaches the partition 600 to the tennis court fence 16. These components are connected as follows: tubular material is connected to configure, for example, a 4 foot long×3 foot high outer frame, the polypropylene windscreen like material has sewn and reinforced sleeves that attaches to the tubular outer framing material to form outer frame, with U-bolts that attaches/secures the frame to a fence. The tubular moldings that run vertical to the court can have small (just big enough for the moldings to fit into) rubber shoes placed on the end of the tubular moldings that extend down to the tennis court surface.

In one contemplated embodiment, the bottom of the frame 620 will rest approximately two inches above the surface of the court 12 so that leaves, debris, and the like will not gather around the bottom of the partition 600. This space will not be higher than the height of a tennis ball so that the tennis ball cannot roll underneath the partition 600. The partition 600 can be used to keep tennis balls from rolling from one court 12 into a tennis court 12 adjacent to it and placed strategically (in between the two courts 12 and secured to baseline fence 16) in an area where numerous balls roll or bounce from one court to the other. The partition 600 is not intended to keep every ball from rolling or bouncing from one court 12 to another but rather to block/prevent a high percentage of balls that would normally enter the adjacent court 12 if it were not for this device.

There is also the option of having a hinge placed on the partition 600 between the partition 600 and the tennis court fence 16 so that the partition 600 can swing back flush against the fence 16 when it is not in use. Another option for the partition 600 is having it in three to four components that be folded into one piece so it can be shipped more efficiently and carried on and off the tennis court 12 more easily.

The technology described herein also comprises a method for deterring tennis balls from going from a first tennis court 12 to an adjacent tennis court 12, the method comprising attaching a partition according to the partition just described above to a first tennis court distal baseline fence 16 approximately halfway between the first tennis court 12 and the adjacent tennis court 12; attaching the partition to a first tennis court proximal baseline fence 16 approximately halfway between the first tennis court 12 and the adjacent tennis court 12, and inserting a placard into each transparent sleeve.

In yet another embodiment a partition for deterring tennis balls from going to an adjacent court comprises: a support for a standing on a tennis court surface, and a covering disposed on the support. In this embodiment the support further comprises a one-piece frame configured to stand upright on a planar surface and having a space beneath the frame and above the tennis court surface, the space having a height less than the height of a regulation tennis ball. The covering may further comprise a water resistant air-permeable covering configured to attach to the support device, where the covering has indicia disposed thereon.

One or more connectors may be configured to releasably attach the support to a tennis court baseline fence.

One or more hinge may be used in attaching the partition to the tennis court baseline fence.

The covering may further include one or more of a transparent sleeve dimensioned for insertion of a sheet of material conveying event information. The indicia can commemorate a facility, an event, an organization or a sponsor, can be a web site address, a telephone number, an email address, a public service message, or the like.

Figure 15:
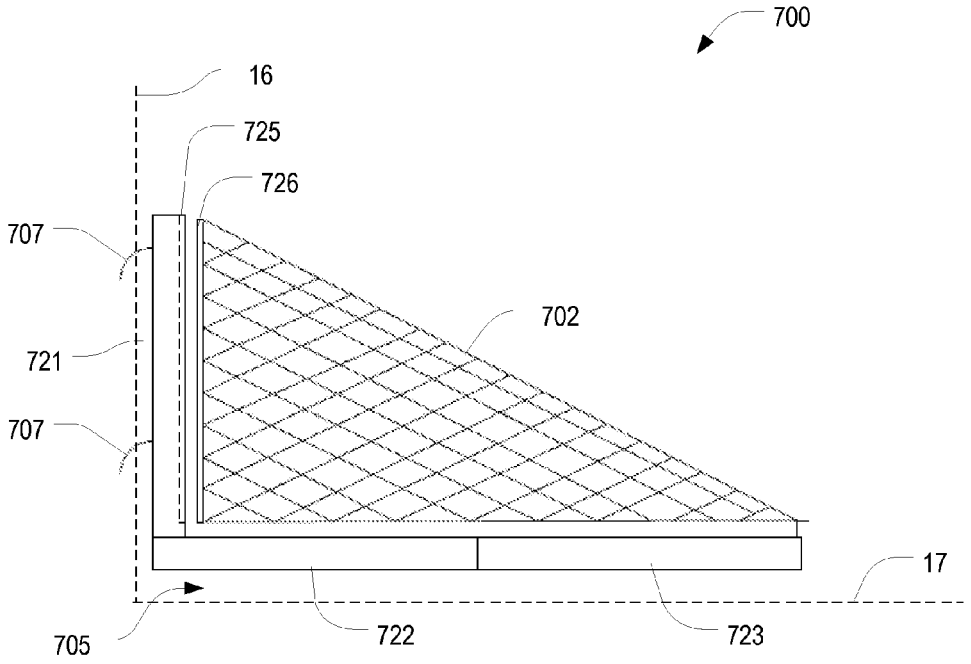
FIG. 15 is a front view of another alternative free-standing tennis court partition in accordance with one or more preferred embodiments of the present invention.
Figure 16:
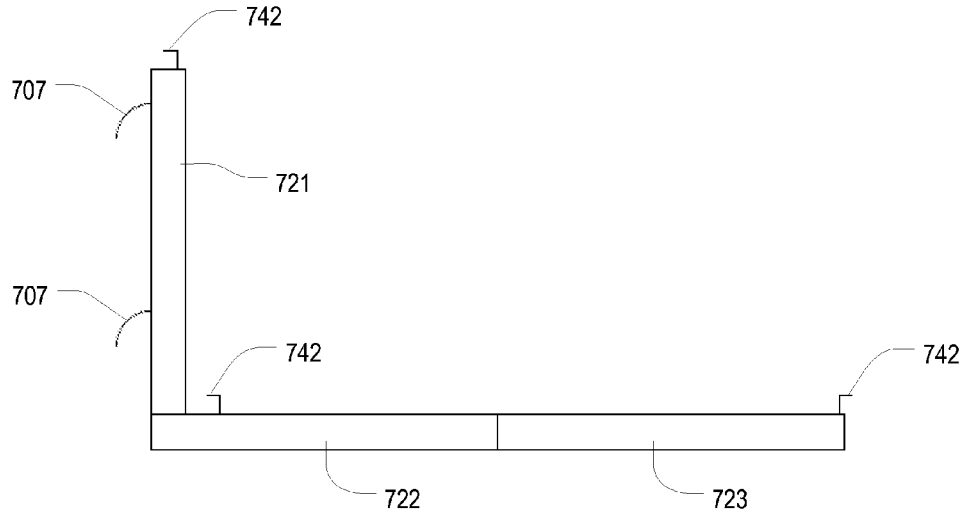
FIG. 16 is a front view of the free-standing tennis court partition of FIG. 15, shown without a mesh net, but using a different attachment mechanism.
Figure 17:
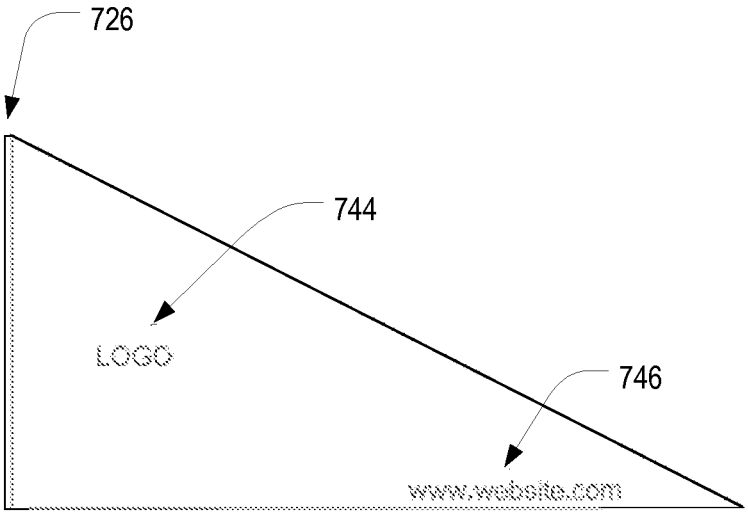
FIG. 17 is a front view of an alternative main body for the partition of FIG. 15.

Other variations of a tennis court partition 700 are shown in FIGS. 15-17, wherein FIG. 15 is a front view of another alternative free-standing tennis court partition 700 in accordance with one or more preferred embodiments of the present invention, FIG. 16 is a front view of the free-standing tennis court partition 700 of FIG. 15, shown without a mesh net, but using a different attachment mechanism, and FIG. 17 is a front view of an alternative main body for the partition of FIG. 15. The tennis court partition 700 of FIG. 15 includes a first rod 721, a second rod 722, a third rod 723, a main body 702, fasteners 707 and a main body 702, which is shown as a mesh net. The first rod 721 connects to the second rod 722 and the third rod 723 connects to the second rod 722, as shown. The first rod includes a groove 725 that accepts a plastic tube or other tongue structure 726 on the mesh net 702. The fasteners 707 connect to the back of the first rod 721 in order for the tennis court partition 700 to be releasably attached to a tennis court fence 16 such that a gap 705 is high enough to allow most debris to not be trapped between court surface 17 and the connected second rod 722 and third rod 723, yet to low enough to stop a tennis ball.

In one embodiment the main body 702 is a mesh net and is attached to the first rod 721 and the third rod 723 by clamps or hooks. In an alternate embodiment, the mesh net is attached to the first rod 721 by sliding in groove 022 and attaching to a hook 742 on the third rod 723. In yet another embodiment the main body 702 is made of hard plastic and has a plastic tube 726 that slides into the groove 725. The main body 702, whether it is a mesh net or a hard plastic, can have indicia thereupon, e.g. a logo 744, contact information 746, and the like.

Figure 18:
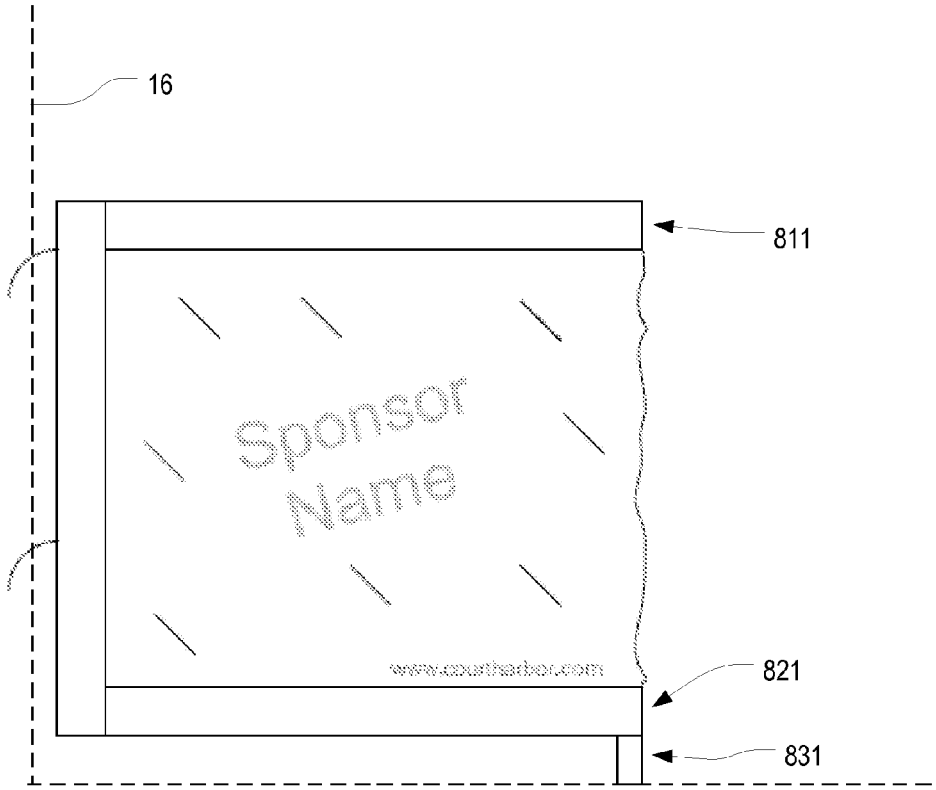
FIG. 18 is a front view of yet another embodiment of a partition.

FIG. 18 is a front view of yet another embodiment of a partition 800, wherein the main body is attached to a top pole 811 and a bottom pole 821, and the bottom pole 821 has a peg 831 attached or affixed thereon to provide support to the bottom pole 821 to the court surface below.

In at least some embodiments, a main body is comprised of hard material, e.g. rubber or plastic, and has strong plastic or metal rods for the perimeter of the device to provide sturdiness and the ability for it to withstand a ball hitting it multiple times. The device may further include fasteners, e.g. latches, of metal or hard plastic, which enables the device to lock into a tennis court fence at the base of the device. In some embodiments a hinge is between the fasteners and the main body of the device to allow the device to swing into the court while being used and swung back over to the fence and latching onto the fence while not being used. In some embodiments the technology described herein has a slot for insertion of identifying indicia therein. In other embodiments an area of the technology is operable for the placement of identifying indicia thereon.

In at least some other embodiments, a main body is comprised of a strong flexible material, e.g. nylon, plastic or cloth, with strong plastic or metal rods for the perimeter of the device to provide sturdiness and the ability for it to withstand a ball hitting it multiple times. The device may further include latches, e.g. metal or hard plastic, that enable the device to lock into a tennis court fence at the base of the device. In some embodiments a hinge is between the latches and the main body of the device to allow the device to swing into the court while being used and swung back over to the fence and latching onto the fence while not being used. In some embodiments the technology described herein has a slot for insertion of identifying indicia therein. In other embodiments an area of the technology is operable for the placement of identifying indicia thereon.

In an exemplary embodiment the device is comprised of two (2) soft, flexible poles, a main pole and a second pole. The main pole is mounted, e.g., via 2 clamps, on the fence between the courts. The second pole is positioned to hover 1-2 inches above the surface of the court. Upon initial install, the second pole is flush with the fence. Once the main pole is mounted on the fence, the second pole is pulled away from the fence until it clicks into position. The main pole is 3' in length and the second pole is 3' in length. The third pole is an extension to the second pole which is shipped in the initial packaging. This third pole has a threaded end which screws into the second pole thus making that pole a total of 3' in length as it hovers above the court's surface.

Once the main bar is mounted on the fence and the second pole is clicked into position, the customer then installs a flag, e.g. a mesh flag. The mesh flag is triangular in shape. The long side of the flag slides into a groove on the main pole until the flag clicks into position. The other end of the flag has a hollow opening which slides over the hook on the end of the third pole. The flexible bars and mesh netting are sturdy enough to withstand the force of the tennis ball, but soft enough to slow the motion of the tennis ball and settle the tennis ball on the original court of play.

In an alternate embodiment the technology described herein has three flexible poles (i.e., bars)—one of which is mounted (e.g., via 2 hooks) on the fence between courts. Once the main bar is mounted on the fence, the 3 feet long×3 feet high mesh netting is pulled out away from the fence into the court. The mesh netting has a soft flexible top pole attached to the top and a soft flexible bottom pole attached to the bottom. The bottom pole has a small adjustable peg that extends out from the bottom pole to rest on the court's surface. This peg supports the far end of the mesh netting as the mesh netting is extended out into the court. The flexible bars and mesh netting are sturdy enough to withstand the force of the tennis ball, but soft enough to slow the motion of the tennis ball and settle the tennis ball on the original court of play. If the device is not desired nor needed, a user can simply push a button at the top of the fence mounted pole, release the clasp and allow the mesh netting to be pushed back flush against the fence. At any time, the device can then be unhooked from the fence and removed. The bar mounted on the fence is approximately 3 feet in height. The bar at the top of the mesh netting and the bar at the base of the mesh netting are both 3 feet in length (therefore extending 3 feet into the court). The bar located along the court surface is suspended approximately 1-2 inches above the court surface.

When the device is not desired or needed, a user can push the second pole back flush against the fence. Additionally, the device can be unhooked from the fence and removed.

The main pole, when mounted on a fence will be approximately 3 feet in height. The pole hovering above the court (second and third poles combined) is 3 feet in length. The bar located along the court surface will suspend approximately 1-2 inches above the court surface.

In one embodiment the technology described herein is portable and is not secured to the tennis court fence. Instead it has a weighed base, thus allowing it to have sufficient inertia to stop tennis balls, yet still be able to be placed on a court during play, and easily removed afterwards. Similarly the second and third pole arrangement can be replaced by a pole that telescopes.

In one embodiment the technology described herein is made by taking a 3 foot long and 3 foot high piece of hard plastic or strong nylon material, running a strong plastic or metal rod (approx ½ inch in diameter inside the perimeter of each outer boundary of the material, taking two metal clamps and attach them to the material, one that is two inches from the top of material and one that is two inches from the bottom of the material, and taking these two clamps and connecting each of them to the tennis court fence. (Once clamped to the tennis court fence the device can extend up to five feet out from the tennis court fence and stand approximately two feet above the court. When clamped to the fence, the device is positioned so that there is 2-3 inches between the bottom of the device and the tennis court playing surface.)

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A tennis court facility utilizing a temporary tennis court partition to prevent balls played on one tennis court from entering another tennis court, comprising:

a first tennis court and a second tennis court, the first and second tennis courts disposed next to each other; and a temporary, removable, portable partition disposed between the first and second tennis courts to block balls played on the first tennis court from entering the second tennis court, the partition including:

a vertical frame, and an advertising panel, removably supported by the vertical frame;

wherein the vertical frame has a front side and a back side and wherein the advertising panel is a sleeve that is installed over a top of the vertical frame and covers the front and back sides of the vertical frame.

2. The tennis court facility of claim 1, wherein the sleeve includes perforations or other openings to permit airflow therethrough.

3. The tennis court facility of claim 1, wherein the sleeve includes indicia displayed thereon.

4. A tennis court facility utilizing a temporary tennis court partition to prevent balls played on one tennis court from entering another tennis court, comprising:

a first tennis court and a second tennis court, the first and second tennis courts disposed next to each other; and a temporary, removable, portable partition disposed between the first and second tennis courts to block balls played on the first tennis court from entering the second tennis court, the partition including:

a vertical frame, and an advertising panel, removably supported by the vertical frame;

wherein the partition includes a hollow base, flared outward and downward, having a fill port to receive water, sand, or another pourable, fungible substance for weighting the base and partition down, wherein the vertical frame includes two columns and a cross member extending across tops of the two columns, wherein the frame defines front and back sides, and wherein the advertising panel is a hollow sleeve, displaying indicia thereon, that is installed down over the cross member and columns so as to cover the front and back sides of the frame.

5. A method of blocking tennis balls from one tennis court at a tennis facility from entering an adjacent tennis court at the same facility, comprising:

providing a vertical frame defining a front and a back;

installing a sleeve over the frame, the vertical frame and the sleeve defining a temporary, removable, portable partition;

temporarily placing the partition between a first tennis court and a second court at a tennis facility, the first and second tennis courts being adjacent to each other;

via the partition, blocking a tennis ball played on the first tennis court from entering the second tennis court; and after play has concluded on the first tennis court, removing the partition from between the first and second tennis courts.

* * * * *